US005322458A

United States Patent [19]

Hennemann et al.

[11] Patent Number: 5,322,458

[45] Date of Patent: Jun. 21, 1994

[54] COLLECTIVE CONENCTION DEVICE FOR WIRE CONDUCTORS

[75] Inventors: Lothar R. Hennemann, Enger; Hans-Josef Köllmann, Minden, both of Fed. Rep. of Germany

[73] Assignee: WAGO Verwaltungsgesellschaft mbH, Minden, Fed. Rep. of Germany

[21] Appl. No.: 951,868

[22] Filed: Sep. 25, 1992

[30] Foreign Application Priority Data

Sep. 26, 1991 [DE] Fed. Rep. of Germany ..... 4132407

[51] Int. Cl.[5] ..... H01R 11/09

[52] U.S. Cl. ..... 439/723; 439/787

[58] Field of Search ..... 439/709, 723, 724, 787, 439/789, 507, 510, 513, 717

[56] References Cited

U.S. PATENT DOCUMENTS

| | | | |
|---|---|---|---|
| 2,748,365 | 5/1956 | Speck | 439/723 X |
| 3,312,874 | 4/1967 | Stanback | 439/723 X |
| 3,693,137 | 9/1972 | Brumfield | 439/723 X |
| 4,171,861 | 10/1979 | Hohorst | 439/513 X |

*Primary Examiner*—Khiem Nguyen

*Attorney, Agent, or Firm*—Salter, Michaelson & Benson

[57] ABSTRACT

A collective connection device for wire conductors of electrical power distribution systems accommodates a compact arrangement of a multiple number of smaller and larger terminal blocks on a busbar. The busbar of the device is divided into two primary decks respectively located at the first and second ends of the busbar and upper and lower centrally located decks which form an electrical bridge between the primary end decks.

9 Claims, 3 Drawing Sheets

COLLECTIVE CONENCTION DEVICE FOR WIRE CONDUCTORS

BACKGROUND OF THE INVENTION

The invention relates to a collective connection device for wire conductors of electrical power distribution systems.

Such collective connection devices are common for ground wires, neutral conductors, or other conductors of the same potential in industrial distribution plants, in household distributing systems, and also in industrial control structures. They all have a current collecting busbar, in which a plurality of terminal blocks are integrated or are fitted onto or placed onto separately manufactured terminal blocks, so that they are mechanically and electrically connected with the current collecting busbar. The terminal blocks themselves can be used for the wiring of flexible and/or rigid conductors, and they are commonly in the form of spring couplings or screw clips.

The German Industrial Standard (DIN 43-871) requires that such collective connection devices must have a multiple number of smaller terminal blocks for wire conductors of a smaller cross section (e.g. 14 terminal blocks with a terminal region of 1.5–4 $mm^2$) and a lesser number of larger terminal blocks for wire conductors of a larger cross section (e.g., one input terminal and two output terminals, each with a terminal region of 6–16 $mm^2$).

This multiple number of terminal blocks per collective connection device requires a considerable length of the current collecting busbar if the terminal blocks are tightly arranged right next to one another on the collecting busbar. In electrical power distribution systems, this often leads to place or space problems, especially since in the crosswise extent to the longitudinal direction of the busbar, the space required for the collective connection device, e.g., in a service cabinet, is always determined by the larger terminal blocks for the wire conductors of the greatest cross section.

SUMMARY OF THE INVENTION

The object of the invention is to create a collective connection device which permits a compact arrangement of a multiple number of terminal blocks for wire conductors having large and small cross sections in the smallest amount of space, yet does not prevent the simple and secure wiring of the collective connection device.

According to the instructions of the invention, the busbar of the collective connection device is divided into regions corresponding to the maximum current load that is theoretically possible in these regions. This results in the formation of primary regions which are formed by the entire current-conducting cross section of the busbar, and secondary regions, whose current-conducting cross section is to be dimensioned relatively smaller. The primary region serves as a so-called main deck for the arrangement of the larger terminal blocks for wire conductors having larger cross sections. The secondary regions are divided into an upper deck and a lower deck running parallel to each other and serve for the arrangement of smaller terminal blocks for the wire conductors having small cross sections. For example, a busbar according to the invention with an upper deck and a lower deck has in both of these secondary regions only half of the current-conducting cross section of the full cross section of the busbar, which is utilized for the primary deck of the busbar.

The advantages of the new collective connection device are considerable. The terminal blocks for the wire conductors having the smaller cross section can be accommodated in an extremely compact arrangement on the upper and lower decks. The longitudinal extent of the busbar in this region is considerably reduced, and for example, with the use of an upper deck and a lower deck, it is one-half that of the longitudinal extent of known collective connections.

Nevertheless, the crosswise extent of the new collective connection device is not increased, when measured crosswise to the longitudinal extent of the busbar, since with the use of an upper deck and a lower deck, the double structural height given thereby of the smaller terminal blocks also remains within the bounds of the total structural height of the larger terminal blocks, which are positioned on the adjacent primary deck(s). In this way one has on hand the means to select the respective spatial arrangement of the primary deck(s) relative to the adjacent upper and lower decks, such that the outer contours of the large and small terminal blocks mounted on the decks are adapted to one another to a great extent, and so that the crosswise extent of the collective connection device overall has the smallest possible dimension.

The new collective connection devices may, e.g., be designed with only one primary deck, which lies approximately in the center of the busbar and an upper and lower deck extend away from it on both sides.

However, one form of an embodiment of the invention is particularly advantageous and particularly stable; this is where the busbar has a primary deck on each of its two ends and the upper deck and the lower deck connect the two primary decks with each other.

In this way it is particularly simple according to manufacturing technology to form the upper deck and the lower deck from a flat material and then to form the current-conducting total cross section of the primary deck(s) by overlying the flat material in these regions of the busbar.

If terminal blocks which are operated and wired from the front are used for the collective connection device, then the upper deck and the lower deck can be considered to lie directly above one another in the conductor introduction direction. In the case of screw connections, which must be operated from above and displaced by 90° with respect to the conductor introduction direction, it is appropriate to arrange the upper deck in a displaced manner relative to the lower deck.

It is appropriate to incorporate the new busbar with the terminal blocks in a housing of insulation material, which covers in a contact-secure manner at least the visible side of the collective connection device in a power distribution system.

In this way an insulation-protected collective connection device is formed with compact housing dimensions, and a particularly appropriate form of the invention provides that the housing of insulation material is provided on its end with locks and/or dovetail joints in such a way that two or more housings of insulating material or collective connection devices according to the invention are locked in line with one another or with end-side holding and attaching adapters.

In this way, the collective connection devices can be constructed as modules and can be adapted to each individual case of application by different holding and attachment adapters.

According to another form of embodiment of the invention, since each of the end-sided primary decks also may have connection slots for inserting a jumper bar, it is easily possible to connect two or more collective connection devices joined in line with one another, if desired, in an electrically conducting manner, so that a greater multiplicity of terminal blocks of the same potential is readily possible.

BRIEF DESCRIPTION OF THE DRAWINGS

Examples of embodiments of the invention based on the drawings will be described in more detail below wherein.

DESCRIPTION OF THE PREFERRED EMBODIMENTS

In the first example of an embodiment of the invention according to FIGS. 1–4, FIG. 3 shows the structure of the busbar 7. This has two primary decks 8 and 9, which are found on each end of the busbar.

Proceeding from these main decks, the busbar is divided into an upper deck 10 and a lower deck 11.

Figure 4:
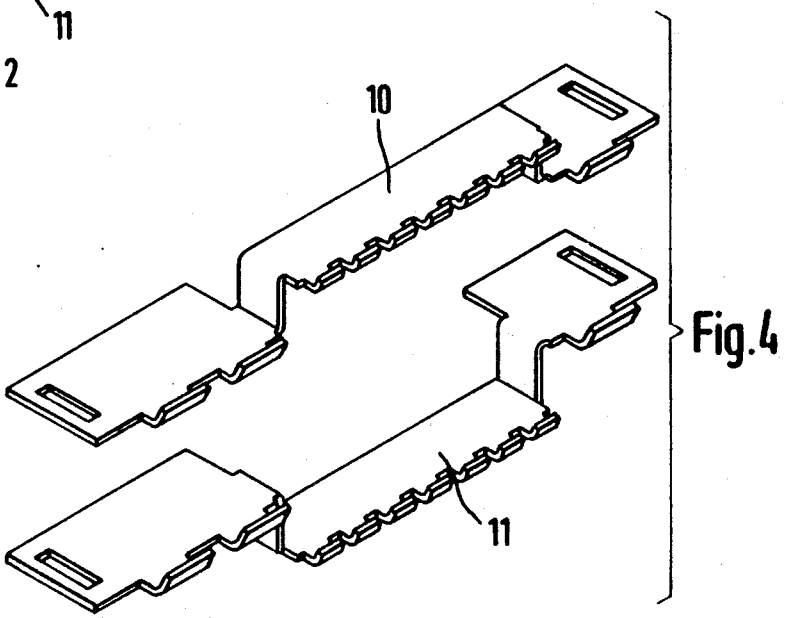
FIGS. 3 and 4 show the structure of the busbar of the collective connection device according to FIGS. 1 and 2.
Figure 3:
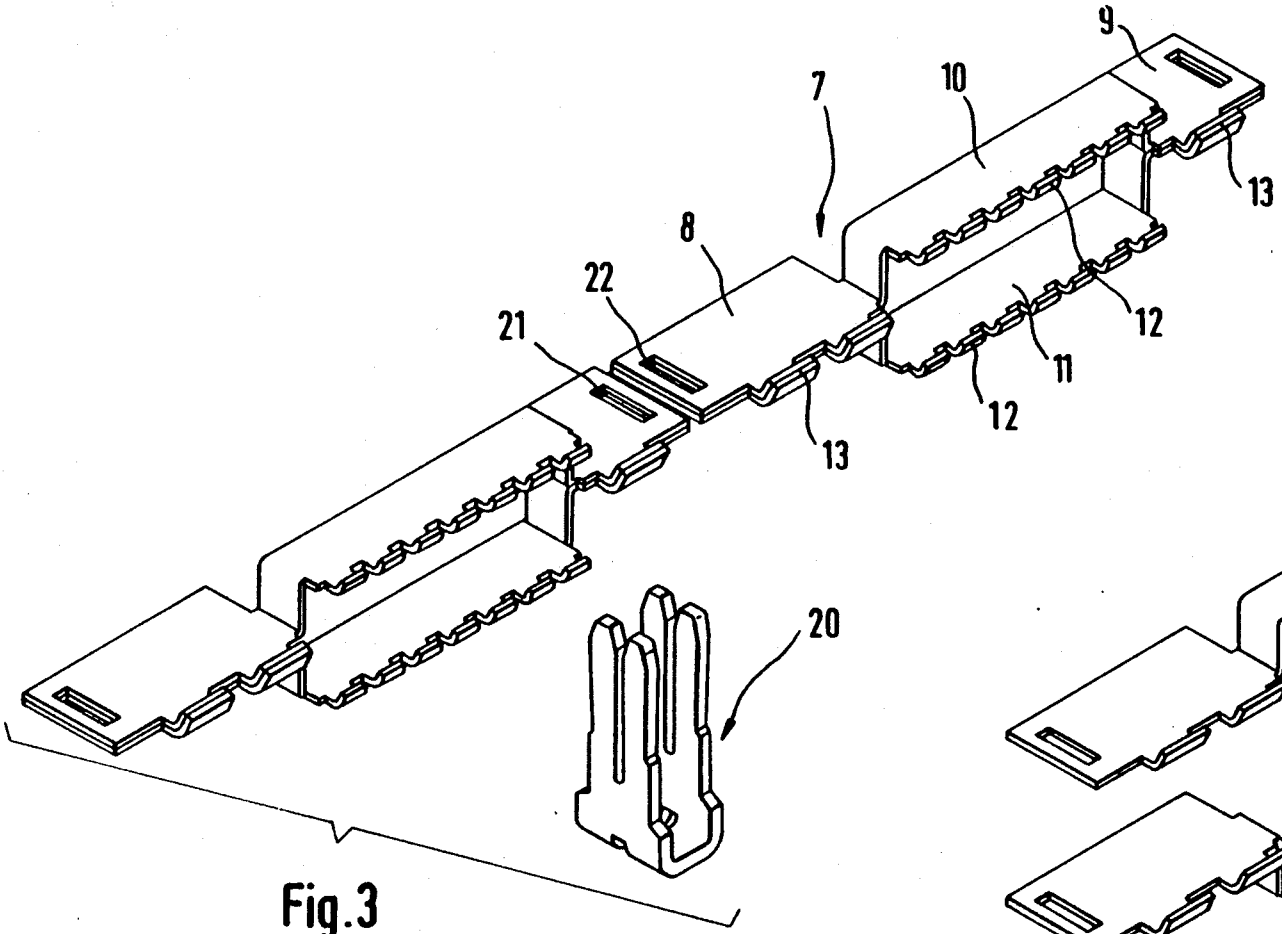

FIG. 4 shows the way the busbar is manufactured. First the upper deck 10 and the lower deck 11 are each formed from a flat material, whereby at both ends, half of the thickness of the material of the later primary deck is formed with the same material. Later primary decks 8 and 9 according to FIG. 3 are then formed by a simple overlying of the two formed material strips of FIG. 4.

The material strips lying on top of one another in the region of the primary deck may also be welded together or locked, but this is not required in the present example of embodiment, since the material strips of the primary deck are joined together by placement of the cage tension spring 27 (see FIG. 2) thus designated by the Applicant in a spring lock manner.

Cage tension springs are part of the state of the art and are described in detail in DE Patent 2,706,482.They are each placed on a projecting tongue 12 or 13 of the respective deck and each is held onto the deck in a self-bearing manner by its own spring pre-tension by clamping tongues 12 or 13 between its deck-side device leg and the terminal leg.

Figure 2:
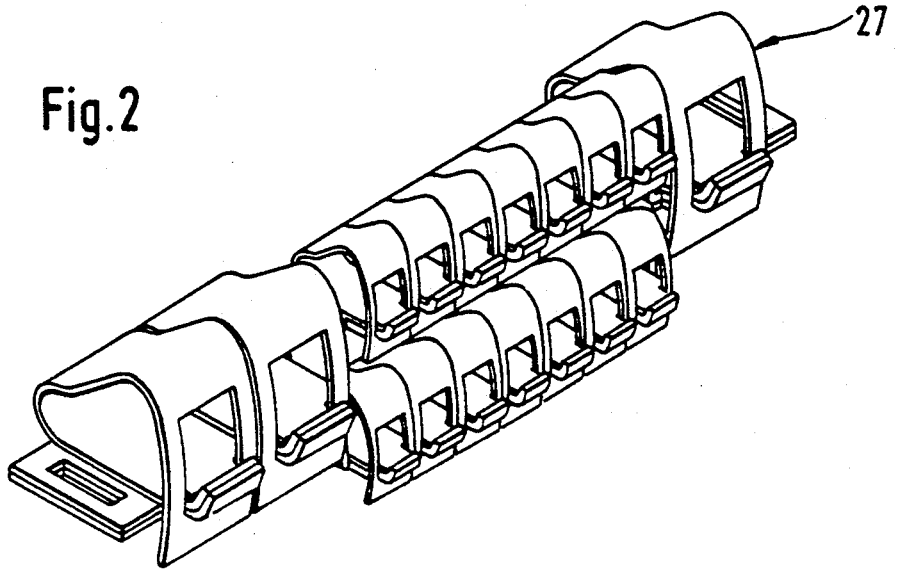

FIG. 2 illustrates very well the extremely compact arrangement of all cage tension springs as terminal blocks on the respective decks. The smaller terminal blocks for the wire conductors of smaller cross section are arranged on upper deck 10 and lower deck 11, and the 3 larger terminal blocks for wire conductors of larger cross section are arranged on the end-side primary decks.

Figure 1:
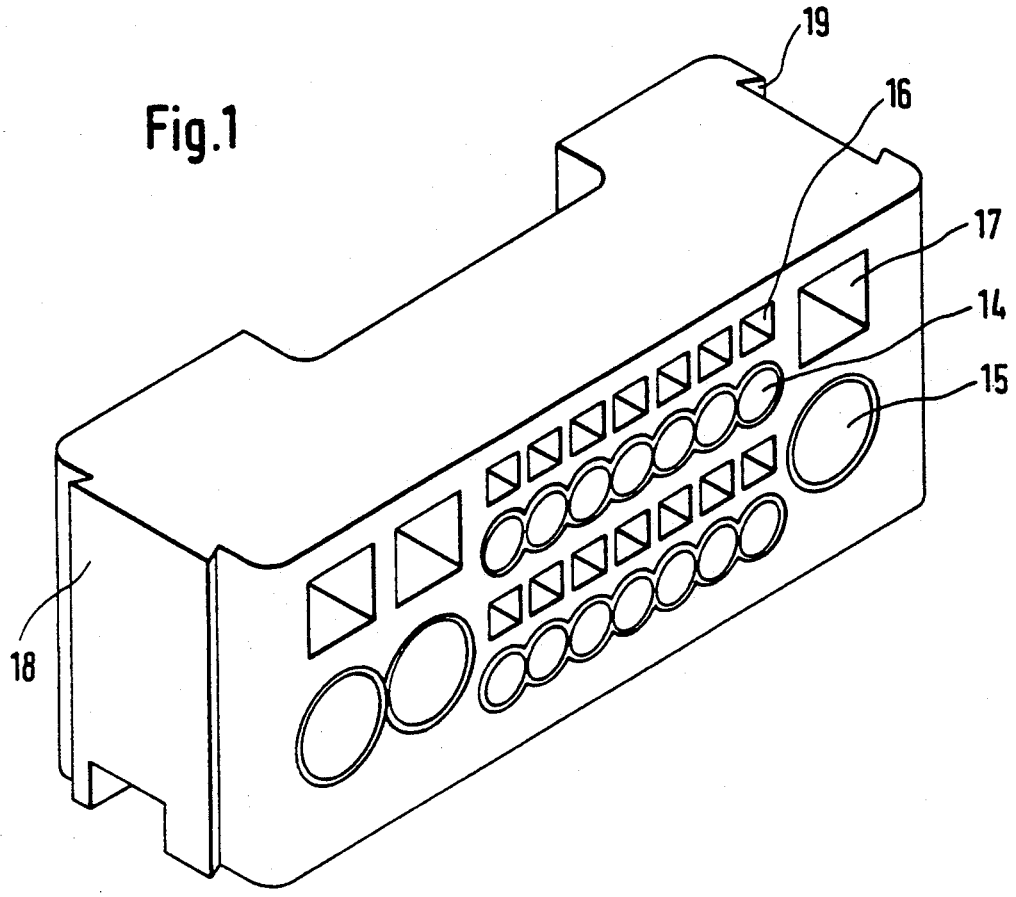
FIGS. 1 and 2 show in perspective view the housing of insulation material and the metal insert of a collective connection device according to the invention.

This entire metal insert will then be inserted into a housing of insulation material according to FIG. 1 in a particularly preferred example of embodiment. This housing has in front the required conductor introduction openings 14 and 15 and the assigned actuation openings 16 and 17 for opening the respective contact points or cage tension springs, so that flexible or rigid conductors can be wired into them as desired.

The housing of insulation material according to FIG. 1 has end-side dovetail joints, a positive one 18 and a negative one 19. In this way two housings of insulation material placed in line can be locked together. Each housing of insulation material contains its own collective connection according to FIG. 2, but which—as FIG. 3 shows—can be connected together electrically by means of a jumper bar 20, by inserting this jumper bar from below into the respective connector slots 21 and 22, which are each provided on the outer end of primary decks 8 and 9.

The above-mentioned dovetail joints 18 and 19 serve as desired also for the purpose of locking end-side holding and attachment adapters to the housing of insulation material, so that the collective connections according to the invention will be mounted without problem in a user-specific manner.

Figures 5, 6:
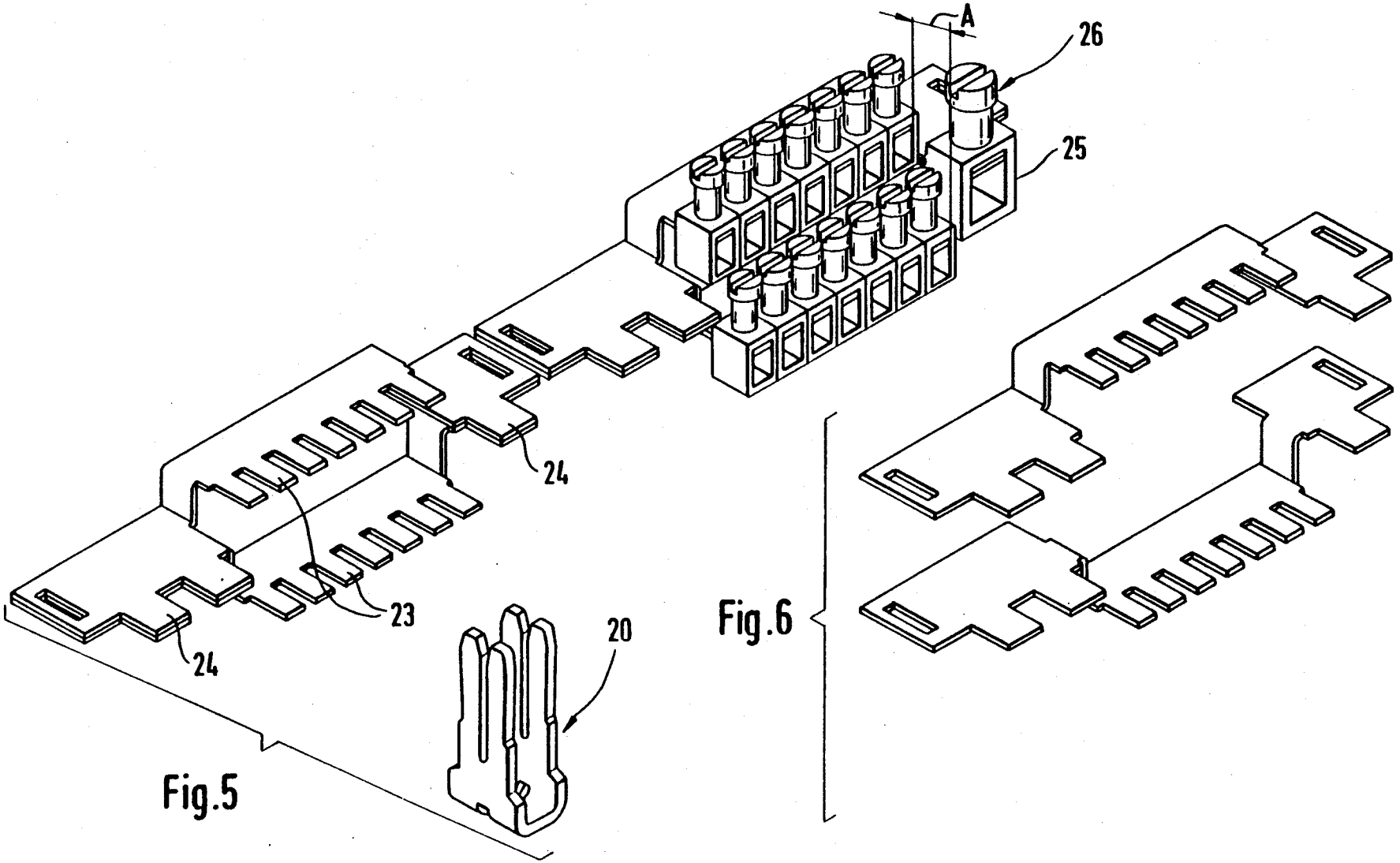
FIGS. 5 and 6 show the metal insert and the construction of a second form of embodiment of the collective connection device of the invention.

FIGS. 5 and 6 show a second example of an embodiment of the invention with a system structure similar to that shown by the first example of embodiment according to FIGS. 1–4, so that an additional general description can be dispensed with here.

More specifically, the tongues 23 and 24 provided on the upper deck and on the lower deck, as well as the two primary decks, are designed in a straight line so that common screw clips 26 provided with a tension piece 25 can be mounted easily on them.

Such screw clips must be actuated from above and displaced by 90° with respect to the conductor introduction direction, so that it is appropriate to displace the upper deck relative to the lower deck by dimension A, as shown in FIG. 5.

In other respects, the example of the embodiment according to FIGS. 5 and 6 may also be provided with a housing of insulation material and it can also be utilized with a jumper bar 20 in order to connect together the lined-up collective connection devices.

What is claimed is:

1. A collective connection device for wire conductors of an electrical distribution system having a multiple number of terminal blocks of the same potential, all of which are mechanically and electrically connected with a current collecting busbar, wherein a majority of said terminal blocks are designed for receiving wire conductors of smaller cross-section and a minority of the terminal blocks are designed for receiving wire conductors of larger cross-section, said busbar comprising:

a first deck member which is formed from a flat material, said first deck member including an upper deck portion and a primary deck portion; and a second deck member which is formed from a flat material, said second deck member including a lower deck portion and a primary deck portion, said first and second deck members being received together in adjacent relation so that said upper and lower deck portions run substantially parallel to each other and so that said respective primary deck portions overlie each other and cooperate to form an integral primary deck having a total current carrying cross-section that is greater than said upper and lower deck portions, said terminal blocks for receiving larger cross section wire conductor being arranged on said primary deck, said terminal blocks for receiving smaller cross-section wire conductors being arranged only on said upper and lower decks.

2. A current collecting busbar for a collective connection device comprising:

upper and lower decks each having first and second ends and a predetermined current carrying cross-section;

said upper deck and said lower deck running substantially parallel to each other, said upper and lower decks including terminal blocks which are adapted for receiving small cross-section wire conductors, said upper deck and said lower deck merging at said first ends to form a primary deck having a total current carrying cross-section that is greater than said upper and lower decks, said primary deck including terminal blocks which are adapted for receiving larger cross-section wire conductors.

3. In the current collecting busbar of claim 2, said upper deck and said lower deck further merging at said second ends to form an additional primary deck, thereby providing a primary deck at each end of said upper and lower decks.

4. In the current collecting busbar of claim 2, said primary deck including a connector slot therein which is adapted for receiving a jumper bar for electrically connecting two of said busbars.

5. In the current collecting busbar of claim 2, said upper deck and said lower deck being horizontally displaced from each other so that screw-type terminal blocks received thereon may be accessed from above.

6. The current carrying busbar of claim 2 further comprising a housing of insulation material.

7. In the current carrying busbar of claim 6, said housing including dovetail joints on opposing ends thereof, such that two or more housings may be joined together in linear alignment.

8. A current collecting busbar for a collective connection device comprising:

a first deck member which is formed from a flat material, said first deck member including an upper deck portion and a primary deck portion; and a second deck member which is formed from a flat material, said second deck member including a lower deck portion and a primary deck portion, said first and second deck members being received together in adjacent relation so that said upper and lower deck portions run substantially parallel to each other and so that said respective primary deck portions overlap and cooperate to form an integral primary deck being located on opposite sides of said upper and lower deck portions and having a total current carrying cross-section that is grater than either of said upper and lower deck portions.

9. In the busbar of claim 8, said primary deck including at least one terminal block which is adapted for receiving a larger cross-section wire conductor, said upper and lower deck portions including multiple terminal blocks which are adapted to receive small cross-section wire conductors.

* * * * *